US009352762B2

(12) United States Patent
Click et al.

(10) Patent No.: US 9,352,762 B2
(45) Date of Patent: May 31, 2016

(54) DUAL INDEPENDENT CONTROL HYDRAULIC SWITCH MACHINE

(71) Applicant: VOESTALPINE NORTRAK, INC., Cheyenne, WY (US)

(72) Inventors: Gary Click, Birmingham, AL (US); Brent Duffner, Pinson, AL (US)

(73) Assignee: VOESTALPINE NORTRAK INC., Cheyenne, WY (US)

( * ) Notice: Subject to any disclaimer, the term of this patent is extended or adjusted under 35 U.S.C. 154(b) by 495 days.

(21) Appl. No.: 13/897,265

(22) Filed: May 17, 2013

(65) Prior Publication Data

US 2014/0339373 A1 Nov. 20, 2014

(51) Int. Cl.
*B61L 5/04* (2006.01)

(52) U.S. Cl.
CPC ..... *B61L 5/04* (2013.01)

(58) Field of Classification Search
CPC ..... B61L 5/02; B61L 5/065; B61L 5/06; B61L 5/04; B61L 5/045
See application file for complete search history.

(56) References Cited

U.S. PATENT DOCUMENTS 3,528,320 A * 9/1970 Maniker ..... F16H 37/00 74/625
3,691,371 A 9/1972 Hylen
4,213,588 A 7/1980 Bowles
4,938,438 A 7/1990 Farrell et al.
5,417,392 A 5/1995 Wyatt
5,419,518 A 5/1995 Fiorenzo
5,494,243 A 2/1996 Kuhn
5,504,405 A 4/1996 Hager
5,531,408 A * 7/1996 Wechselberger ..... B61L 5/02 246/257
5,775,647 A 7/1998 Wyatt
6,164,601 A 12/2000 Scheer et al.
6,220,553 B1 * 4/2001 Bobb ..... B61L 5/02 246/358
6,427,950 B1 8/2002 Hoyer et al.
6,568,641 B2 5/2003 Hoyer et al.
7,267,304 B2 9/2007 Scheer
8,297,559 B1 * 10/2012 Voegeli ..... B61L 5/02 246/410
8,302,915 B2 11/2012 Biagiotti
2011/0049308 A1 3/2011 Beaman et al.

FOREIGN PATENT DOCUMENTS

DE 3825182 2/1990

* cited by examiner

*Primary Examiner* — Mark Le
(74) *Attorney, Agent, or Firm* — Marger Johnson

(57) ABSTRACT

A hydraulically powered switch machine having power and manual operating modes, and a dual disconnect mechanism. In power operation mode, the machine may be operated remotely, or using controls located on or near the machine. In the event of power failure, the machine may be operated manually. The dual disconnect mechanism physically disconnects the powered throw mechanism when the machine is operating in manual mode and physically disconnects the manual throw mechanism when the machine is operating in power mode, in both cases preventing unexpected movement of the manual throw mechanism.

20 Claims, 3 Drawing Sheets

DUAL INDEPENDENT CONTROL HYDRAULIC SWITCH MACHINE

FIELD OF THE INVENTION

This invention relates to switch machines. In particular, this invention relates to hydraulically operated switch machines having dual independent control mechanisms.

BACKGROUND OF THE INVENTION

Switch machines are used to move railroad switch points. Many machines are manually operated, requiring an operator to physically force a manual throwing device to move, working against the weight of the switch points and the effects of friction and inertia. In response to the high physical toll such machines took on the operator, switch machines, such as those described in U.S. Pat. No. 4,938,438 to Farrell, U.S. Pat. No. 5,419,518 to Fiorenzo and U.S. Pat. No. 5,494,243 to Kuhn, were improved to provide a better mechanical advantage and ease the physical load on the operator.

Many switch machines also have power operating modes, such as those described in U.S. Pat. No. 5,775,647 to Wyatt, German Patent No. 3825182 to Windgassen et al., each of which disclose hydraulically-assisted switch machines. It is also known to use electrically powered switch machines, such as those disclosed in U.S. Pat. Nos. 6,427,950 and 6,568,641, both to Hoyer et al.

While hydraulic machines generally contain fewer parts than electrical machines and therefore are simpler and cheaper to construct and maintain, electrical machines were said to be an improvement over hydraulic machines because the hydraulic machines could be susceptible to failure due to leakages in the machine itself as well as all external pipes, conduits and hoses, and because hydraulic machines require an external source of hydraulic power, which is not always readily available. However, electrically powered machines also require a power source to operate the machine. In some lightly populated or underdeveloped areas, it may be difficult to ensure that a reliable power source is always available, and also difficult to constantly have someone checking the machine. Further, if for some reason a power source is unavailable, a powered switch machine is inoperable.

It is therefore preferable to provide a secondary manual operating mode, so that a switch machine may be operated even without power. U.S. Pat. No. 8,297,559 to Voegeli et al. describes a hand throw mechanism designed to be retrofitted on an in-tie electrical switch machine, to operate the machine in case of power loss. U.S. Pat. Nos. 6,164,601 and 7,267,304 to Scheer et al. disclose electrical switch machines with manual hand throw levers to be used when electrical power is not available. Other dual control machines are described in U.S. Pat. No. 5,417,392 to Wyatt, which provides a hand pump by which the hydraulic fluid within the system may be manipulated to operate the points. U.S. Pat. No. 4,213,588 to Bowles discloses a hydraulic actuator on a trailable switch machine having a pair of manual controls to move a hydraulic valve manually, thereby allowing manipulation of the fluid within the machine as needed to move the points. U.S. Pub. No. 2011/0049308 to Beaman et al. discloses a hydraulic switch machine in which the dual control comprises a hand pump for manual operation, and a hydraulic actuator for power operation. A directional selection lever may be used to move a first directional control valve to select manual operation, or to move a second directional control valve, which is electrically controlled by valve control solenoids, to select powered operation. Controls within the hydraulic manifold hydraulically isolate the hand pump during power operation. However, none of Wyatt, Bowles or Beaman addresses the issue of manually actuating the machine if hydraulic pressure is not available.

Another potential issue with such machines is the nature of the control over the operating mode. If an operator is in the process of manually throwing a switch and power is suddenly restored to the machine, the interdependence between the power and manual operating modes generally means that the manual throw lever could suddenly begin to move on its own with great force, potentially causing serious injuries to the operator.

In electrical switch machines, this issue has been typically addressed by disrupting the power circuit when the switch machine operates in manual mode. U.S. Pat. No. 5,504,405 to Hager discloses a powered system with a manual operating option, in which an electrical cutout switch is provided as a fail-safe mechanism. One drawback with this type of system is the possibility of tampering; with an electric motor, it is possible to bypass the cutout switch and allow the motor to operate even if the system appears to be in manual mode. U.S. Pat. No. 3,691,371 to Hylen describes a powered system with a manual operating option, in which an electrical cutout switch is provided in cooperation with a manual throw lever to prevent the motor from operating when the hand throw lever is not in its resting position. As a secondary fail-safe, Hylen also describes a lock plate that must be moved before the manual throw lever can be operated; movement of the lock plate disrupts the electrical circuit and shorts out the motor. However, as noted, a safety mechanism that relies solely on disrupting the electrical circuit may be bypassed.

With respect to hydraulic switch machines, similar steps can be taken, such as disconnecting the power source to the hydraulics when the switch machine is in manual operating mode, as described in U.S. Pat. No. 8,302,915 to Biagiotti. Again, this is not completely fail-safe, as a hydraulic motor could itself be shorted to provide power, even if its battery is disconnected.

It is therefore an object of this invention to provide a switch machine that overcomes some or all of the foregoing difficulties.

It is a further object of the invention to provide a switch machine that combines an independent hydraulic powered operating mode with an independent manual operating mode and a dual disconnect mechanism to positively mechanically prevent the machine from operating in one mode if the other mode is selected.

It is a further object of the invention to provide a switch machine that combines an independent hydraulic powered operating mode with an independent manual operating mode, a dual disconnect mechanism to positively mechanically prevent the machine from operating in one mode if the other mode is selected, and a second disconnect mechanism to positively electrically prevent the machine from operating if the dual disconnect mechanism is not properly engaged in the power operating mode.

These and other objects of the invention will be better understood by reference to the detailed description of the preferred embodiment which follows. Note that the objects referred to above are statements of what motivated the invention rather than promises. Not all of the objects are necessarily met by all embodiments of the invention described below or by the invention defined by each of the claims.

SUMMARY OF THE INVENTION

In one aspect, the invention comprises a switch machine for switch stands controlling points at a switch. In power operation mode, the machine may be operated remotely, or using controls located on the machine. In the event of power or hydraulic failure, the machine may be operated manually. The machine comprises a dual disconnect mechanism to disconnect the hydraulic throw mechanism when the machine is operating in manual mode and prevent unexpected movement of the manual throw mechanism, which could injure a worker attempting to manually throw the switch points. Similarly, the dual disconnect mechanism disconnects the manual throw mechanism when the machine is operating in power mode, such that movement of the switch points will not move the manual throw mechanism, avoiding the possibility of injuring a nearby worker.

In one aspect, the invention comprises a switch machine having hydraulic power and manual operating modes, the switch machine comprising a hydraulic actuation system operatively connected to a drive shaft to actuate the drive shaft in the power operating mode; a manual actuation system operatively connected to the drive shaft to actuate the drive shaft in the manual operating mode; and a selector system to selectively operatively disconnect one of the hydraulic actuation system and the manual actuation system from the drive shaft.

In a further aspect the selector system may cause the hydraulic actuation system to disengage from the drive shaft in the manual operating mode, and the manual actuation system to disengage from the drive shaft in the power operating mode. The disengagement may be caused by a clutch moving a travelling distance along the drive shaft. In some embodiments, the clutch has a tooth depth, and the travelling distance is preferably greater than the tooth depth, and may be at least twice the tooth depth.

In a further aspect, the manual actuation system comprises a manual throw actuator; and one or more gears actuated by the manual throw actuator; at least one of the one or more gears being operatively connected to the drive shaft. Various types of manual throws may be provided and are intended to be included within the terms "manual throw" and "manual throw actuator". The at least one or more gears may be operatively engageable with the drive shaft, and may be operatively selectively engageable with the drive shaft by movement of the selector system. Various types of selectors and selector systems may be provided and are intended to be included within the terms "selector" and "selector system". The clutch engages and disengages with the gears by moving a travelling distance along the drive shaft.

The clutch has a tooth depth, and the travelling distance is preferably greater than the tooth depth, and may be at least twice the tooth depth.

In a further aspect, the hydraulic actuation system comprises a hydraulic actuator powered by a hydraulic power unit, the hydraulic actuator being operatively connected to the drive shaft.

The switch machine may further comprise a power drive gear actuated by the hydraulic actuator, the power drive gear being engageable with the drive shaft. The power drive gear may be operatively engageable with the drive shaft through a clutch, which engages and disengages with the gear by movement of the selector means. The clutch engages and disengages with the power drive gear by moving a travelling distance along the drive shaft.

The clutch has a tooth depth, and the travelling distance is preferably greater than the tooth depth, and may be at least twice the tooth depth.

In a further aspect, the switch machine may further comprise an electrical cutoff switch to disconnect the hydraulic actuation system. The cutoff switch monitors the disengagement and disconnects power to the hydraulic actuation system when the hydraulic actuation system is disengaged from the drive shaft.

In a further aspect, the hydraulic actuation system and manual actuation system are independent of one another.

The foregoing was intended as a summary only and of only some of the aspects of the invention. It was not intended to define the limits or requirements of the invention. Other aspects of the invention will be appreciated by reference to the detailed description of the preferred embodiments. Moreover, this summary should be read as though the claims were incorporated herein for completeness.

BRIEF DESCRIPTION OF THE DRAWINGS

The invention will be described by reference to the detailed description of the preferred embodiment and to the drawings thereof in which.

DETAILED DESCRIPTION OF THE PREFERRED EMBODIMENT

Figure 1:
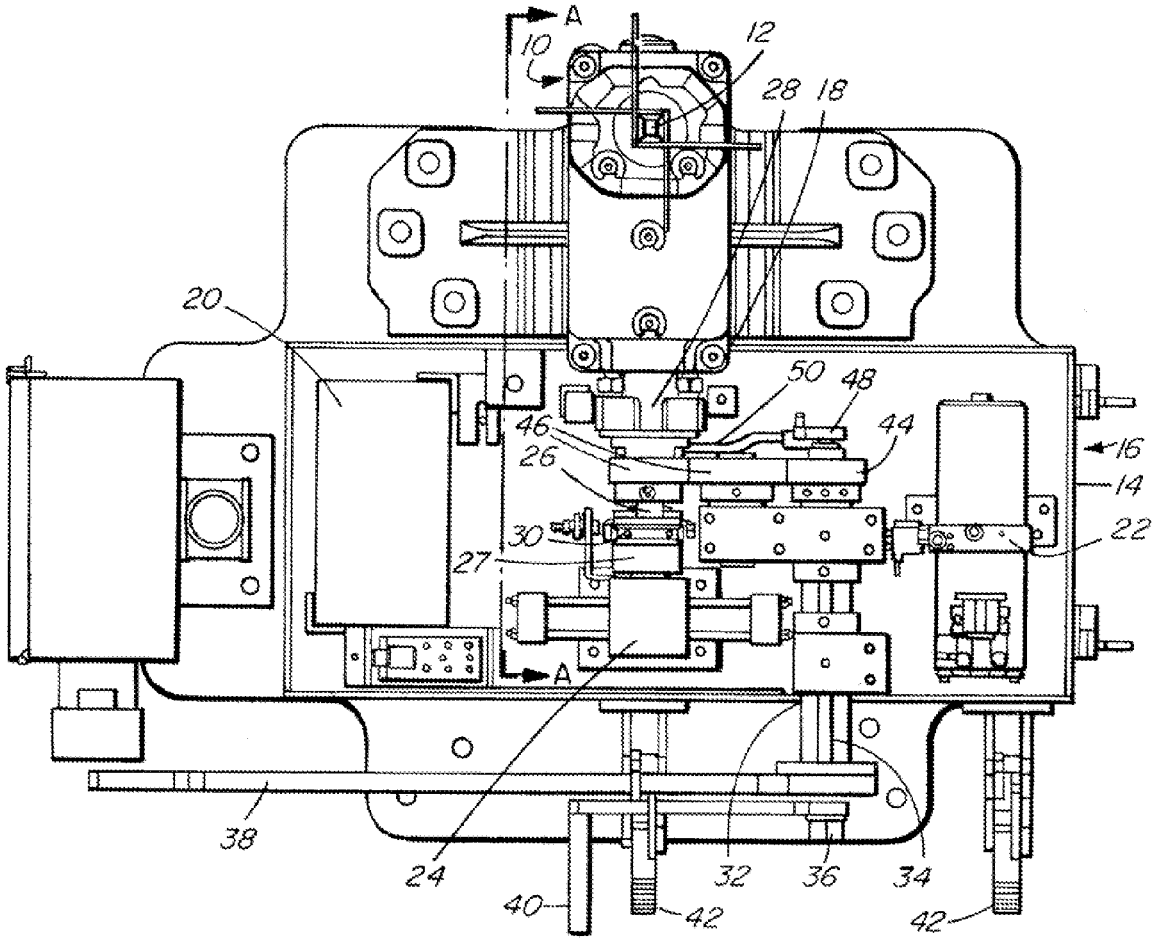
FIG. 1 is a top view of a switch stand and the switch machine of the invention.
Figure 2:
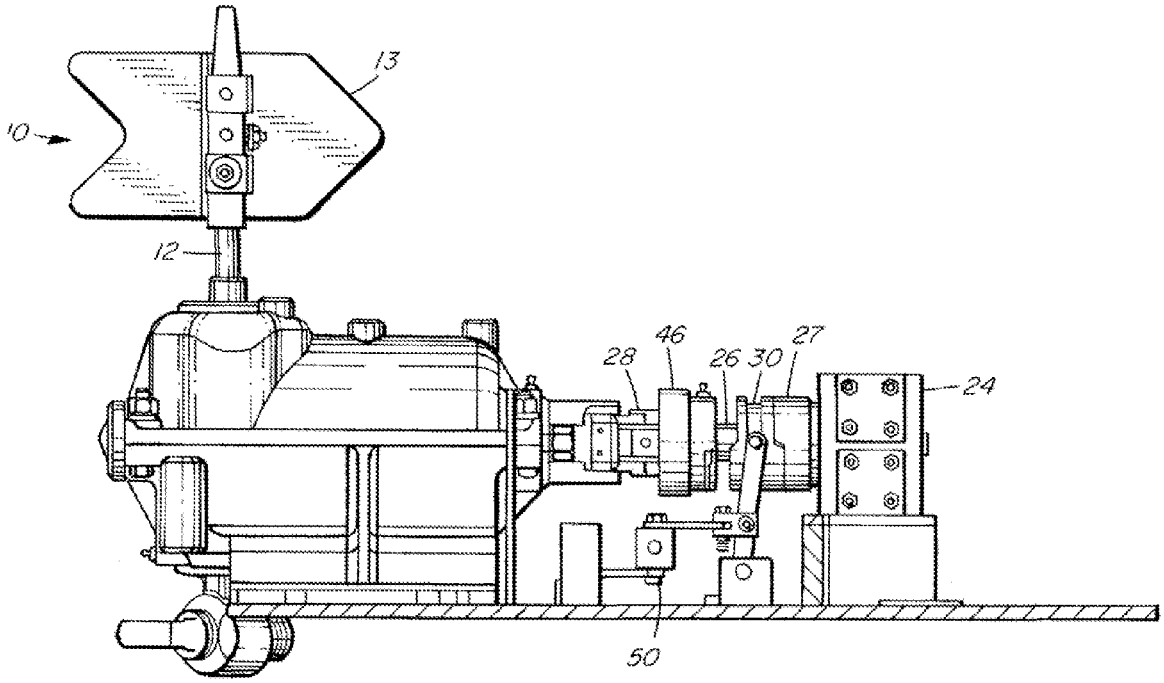
FIG. 2 is cutaway view of the switch stand and switch machine, taken along line A-A.

Referring to FIGS. 1 and 2, a switch stand 10 is adapted to be connected to the railroad switch points (not shown) to move the points between first and second positions. A pivoting shaft or spindle 12 is operatively connected to the switch points and carries a target 13 to indicate whether the switch points are in the first or second position. A housing 14 for the switch machine 16 has a cover (not shown) and a first opening 18 through which the switch machine 16 is connected to the switch stand 10 to translate movement within the switch machine 16 to movement of the switch points.

The housing 14 contains operating mechanisms for both manual and power operating modes, as well as a dual disconnect mechanism by which either the manual or power operating mechanism is rendered inoperable once the other operating mode is chosen.

The power operating mechanism is a hydraulic actuation system that includes a hydraulic power unit 22, which in turn actuates a hydraulic rotary actuator 24. A battery 20 or other suitable power source may be provided to power the hydraulic power unit 22. Movement of the hydraulic rotary actuator 24 rotates a drive shaft 26 via a power drive gear 27 engaged with an engagement means. Various types of engagement means may be provided and are intended to be included within the term "engagement means"; in the embodiment illustrated, the engagement means is an engagement clutch 30, on drive shaft 26. Drive shaft 26 in turn actuates switch stand adapter 28, which is operatively connected to the spindle 12 and the switch points. Rotation of the switch stand adapter 28 therefore moves the switch points from one position to another, and rotates the spindle 12 to indicate the point position. As the switch machine 16 may be used with any suitable switch stand 10, it will be understood that the actual components connecting the switch machine 16 and the switch stand 10 to actuate the switch points depend on the particular structure of the switch machine 10, and do not form part of the invention.

The housing 14 also contains a second opening 32 through which parts of the manual operating mechanism and operating mode selector pass. The manual operating mechanism is a manual actuation system that includes a manual throw shaft 34 actuated by a manual throw lever 38. The operating mode selector may comprise a selector lever 40 or any other suitable actuator that allows a user to actuate operating mode selector shaft 36. Any suitable operating mode selector to secure the levers 38, 40 against unauthorized or unintended movement, such as foot latches 42, and other types of mechanically actuatable mechanisms, may also be provided. The manual operating mechanism may further include a manual driver gear 44 operatively connected to and actuated by the manual throw shaft 34, and one or more driven gears 46, at least one of which is operatively connectable to the switch stand adapter 28, and therefore to the spindle 12 and the switch points. A scotch yoke 48 and a linkage 50 are also provided to operatively connect selector shaft 36 to engagement clutch 30.

When the selector lever 40 is in power mode, the engagement clutch 30 is fully engaged with the hydraulic rotary actuator 24, and is fully disengaged and physically separated from the manual driven gear 46. The hydraulic power unit 22 actuates the rotary actuator 24, rotating the engagement clutch 30, the drive shaft 26 and the switch stand adapter 28, which in turn throws the switch points and rotates the spindle 12. In the power operating mode, the operation of the switch machine 16 may be controlled remotely, or may be controlled with controls located on or near the switch machine 16 or switch stand 10.

When the selector lever 40 is moved to manual mode, selector shaft 36 rotates, causing scotch yoke 48 to rotate. This rotation moves linkage 50, and in turn causes engagement clutch 30 to move a travelling distance away from hydraulic rotary actuator 24, and towards driven gear 46. When the selection of manual operating mode is complete, engagement clutch 30 is fully engaged with the manual driven gear 46, and is fully disengaged and separated from the hydraulic rotary actuator 24. Manually throwing the throw lever 38 will therefore cause the manual throw shaft to rotate, in turn rotating the gears 44, 46, the engagement clutch 30, the drive shaft 26 and the switch stand adapter 28, and actuating the switch points and the spindle 12.

When the selector lever 40 is returned to power mode, the reverse operation happens: scotch yoke 48 rotates and moves linkage 50, which causes engagement clutch 30 to disengage from driven gear 46 and move a travelling distance towards hydraulic rotary actuator 24. If the switch points have been manually thrown an odd number of times, the rotary actuator 24 will self-align to properly engage its face with engagement clutch 30. If the switch points have been thrown manually an even number of times, the rotary actuator 24 does not need to self-align because it is still in proper alignment with the engagement clutch and can simply re-engage. Upon completion of the engagement between clutch 30 and rotary actuator 24, the hydraulic actuation system is fully connected and ready to move the switch points.

The movement of engagement clutch 30 between the rotary actuator 24 and driven gear 46 therefore provides a secure dual disconnect mechanism. The hydraulic actuation system of the switch machine 16 is rendered inoperable if the machine is in manual operating mode, even if power is flowing through the hydraulic system. The manual actuation system of the switch machine 16 is rendered inoperable if the machine 16 is in power operating mode, such that movement of the drive shaft 26 will not cause the manual throw lever 38 to move, while movement of the manual throw lever 38 will not affect the powered operation of the switch machine 16. Such a dual safety mechanism practically eliminates the chances that a mishap can be caused by unexpected machine activation.

Preferably the travelling distance over which the engagement clutch 30 moves is greater than the tooth depth of the engagement clutch 30, such that when engagement clutch 30 is properly connected to the rotary actuator 24, there is a separation distance between the engagement clutch and the driven gear 46, and vice versa. The travelling distance may be approximately twice the tooth depth of the engagement clutch, in order to ensure that the separation distance is sufficient. This provides a means to physically mechanically disconnect the two operating means; if the engagement clutch is not physically connected to either of the rotary actuator 24 or the driven gear 46, the switch machine 16 will not operate, even if, for example, the hydraulic power unit 22 is shorted to run, or if the manual lever 38 is thrown.

Figure 3:
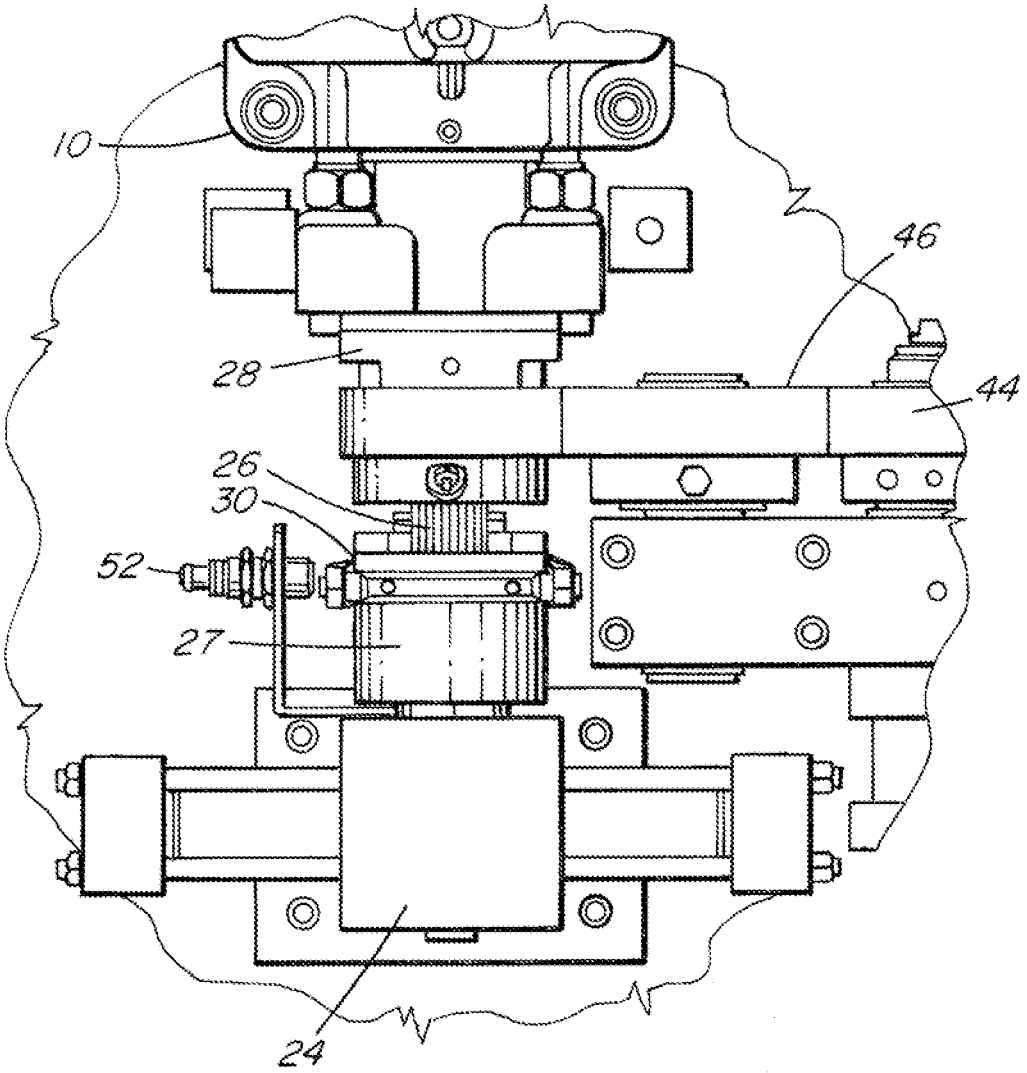
FIG. 3 is an enlarged view of the disconnect mechanisms in the switch machine of the invention.

As a further safety factor, an electrical cutoff switch, such as electrical interlock proximity switch 52, best shown in FIG. 3, may be provided. This switch monitors the position of the engagement clutch 30, and if the clutch 30 is not in the power operating position, i.e. the engagement clutch 30 is not fully engaged with rotary actuator 24, power is prevented from flowing to the hydraulic power unit 22, and the machine is prevented from operating in the power mode. However, the machine may be operated in the manual operating mode as long as the engagement clutch 30 is properly engaged with the driven gear 46.

The switch machine 16 is adapted to continue operating as intended after being trailed through, whether it is operating in power or manual operating mode. The control system will recognize a trail operation and will rotate the drive shaft 26 in both directions to attempt to complete a throw, but the internal components of the switch machine 16 will not be adversely affected or require resetting after being trailed through.

In the foregoing specification, the invention has been described with reference to specific embodiments thereof. However, the scope of the claims should not be limited by the preferred embodiments set forth in the examples, but should be given the broadest interpretation consistent with the description as a whole. The specification and drawings are, accordingly, to be regarded in an illustrative rather than a restrictive sense.

The invention claimed is:

1. A switch machine having hydraulic power and manual operating modes, said switch machine comprising:
   - a hydraulic actuation system operatively connected to a drive shaft to actuate said drive shaft in said power operating mode;
   - a manual actuation system operatively connected to said drive shaft to actuate said drive shaft in said manual operating mode; and
   - a selector system to selectively operatively disconnect one of said hydraulic actuation system and said manual actuation system from said drive shaft;
   - wherein said selector system causes said hydraulic actuation system to disengage from said drive shaft in, said manual operating mode, and said manual actuation system to disengage from said drive shaft in said power operating mode; and
   - wherein said disengagements are caused by a clutch moving a travelling distance along said drive shaft.

2. The switch machine of claim 1 in which said clutch has a tooth depth, and said travelling distance is greater than said tooth depth.

3. The switch machine of claim 2 wherein said travelling distance is at least twice said tooth depth.

4. The switch machine of claim 1 wherein said manual actuation system comprises:
   - a manual throw actuator;

one or more gears actuated by said manual throw actuator; at least one of said one or more gears being operatively connected to said drive shaft.

5. The switch machine of claim 4 wherein said at least one or more gears is operatively engageable with said drive shaft.

6. The switch machine of claim 5 wherein said at least one or more gears is operatively selectively engageable with said drive shaft by movement of said selector system.

7. The switch machine of claim 6 wherein said selective engagement is through said clutch.

8. The switch machine of claim 7 wherein said clutch engages and disengages with said gears by moving a travelling distance along said drive shaft.

9. The switch machine of claim 8 wherein said clutch has a tooth depth, and said travelling distance is greater than said tooth depth.

10. The switch machine of claim 9 wherein said travelling distance is at least twice said tooth depth.

11. The switch machine of claim 1 wherein said hydraulic actuation system comprises a hydraulic actuator powered by a hydraulic power unit, said hydraulic actuator being operatively connected to said drive shaft.

12. The switch machine of claim 11 further comprising a power drive gear actuated by said hydraulic actuator, said power drive gear being engageable with said drive shaft.

13. The switch machine of claim 12 wherein said power drive gear is operatively selectively engageable with said drive shaft by movement of said selector system.

14. The switch machine of claim 13 wherein said selective engagement is through said clutch.

15. The switch machine of claim 14 wherein said clutch engages and disengages with said power drive gear by moving a travelling distance along said drive shaft.

16. The switch machine of claim 15 in which said clutch has a tooth depth, and said travelling distance is greater than said tooth depth.

17. The switch machine of claim 16 wherein said travelling distance is at least twice said tooth depth.

18. The switch machine of claim 1 further comprising an electrical cutoff switch to disconnect said hydraulic actuation system.

19. The switch machine of claim 18 wherein said cutoff switch monitors said disengagement of said hydraulic actuation system and disconnects power to said hydraulic actuation system when said hydraulic actuation system is disengaged from said drive shaft.

20. The switch machine of claim 1 wherein said hydraulic actuation system and said manual actuation system are independent of one another.

* * * * *